United States Patent [19]

White

[11] 4,383,570

[45] May 17, 1983

[54] METHOD OF POURING STEEL INTO A CONTAINER

[75] Inventor: Herbert A. White, Churchill Borough, Pa.

[73] Assignee: American General Supply Company, Pittsburgh, Pa.

[21] Appl. No.: 407,635

[22] Filed: Aug. 12, 1982

Related U.S. Application Data

[63] Continuation-in-part of Ser. No. 194,372, Oct. 6, 1980, Pat. No. 4,354,659.

[51] Int. Cl.[3] ..... B22D 7/12; B22D 27/00

[52] U.S. Cl. ..... 164/57.1; 75/46; 164/133; 164/137

[58] Field of Search ..... 164/59.1, 133, 137, 164/412, 57.1; 249/174, 204, 206; 75/46

[56] References Cited

U.S. PATENT DOCUMENTS

| | | | |
|---|---|---|---|
| 2,907,083 | 10/1959 | Shakely | 249/174 |
| 2,910,747 | 11/1959 | Sterick et al. | 249/206 |
| 4,135,589 | 1/1979 | Hammerton | 164/137 X |
| 4,209,162 | 6/1980 | Petiau | 164/412 X |

FOREIGN PATENT DOCUMENTS

| | | | |
|---|---|---|---|
| 415031 | 8/1934 | United Kingdom | 164/133 |

*Primary Examiner*—Gus T. Hampilos
*Assistant Examiner*—J. Reed Batten, Jr.
*Attorney, Agent, or Firm*—Martin J. Carroll

[57] ABSTRACT

A method of pouring molten steel into a container having a bottom made of material subject to damage by the falling stream includes providing a light weight tin free steel mat made from a plurality of thin sheets each having closely spaced holes therein over most of its area and the sheets being arranged in a plurality of layers arranged to define a honeycombed spongelike structure of considerable thickness having a plurality of discontinuous voids. Substantially flat individual thin sheets are arranged on the top and bottom of the spongelike structure to form an assembly with the top and bottom sheets being made from tin free steel. None of the discontinuous voids extend from the top sheet to the bottom sheet. The mat is lowered into the container and positioned on the bottom after which the molten steel is poured onto the mat which protects the bottom while it melts and is absorbed into the molten steel.

6 Claims, 6 Drawing Figures

METHOD OF POURING STEEL INTO A CONTAINER

This application is a continuation-in-part of my co-pending application Ser. No. 194,372, filed Oct. 6, 1980 and now U.S. Pat. No. 4,354,659 issued Oct. 19, 1982.

The present application relates to a method of pouring steel into a container and more particularly to pouring steel into an ingot mold and into ladles. Ingot molds may have a closed bottom or may be open ended with the bottom end being closed by resting on a stool. In either case the force of the stream falling on the stool erodes the stool or mold bottom and splashing of the metal against the sides of the mold is detrimental. When a stool is used, molten metal may leak into the joint between the mold and stool. As stated in my co-pending application various methods of overcoming these problems have been used, but none have been entirely successful.

When pouring molten steel from an oxygen converter into a ladle which is lined with a refractory the force of the molten steel erodes the refractory bottom. To help prevent rapid erosion a special layer of refractory is used on top of the main refractory bottom. By replacing this protective layer after a relatively short time, the necessity of relining the ladle is postponed. However, it is still costly to replace the refractory protective layer and as the refractory erodes it contaminates the molten steel.

It is therefore an object of my invention to provide a method of pouring steel into a container in such a manner that its bottom is protected from erosion.

Another object is to provide such a method which reduces contamination of the poured metal.

Still another object is to provide a method of top pouring steel into an ingot mold which results in an improved ingot and longer bottom life.

These and other objects will be more apparent after referring to the following specification and attached drawings in which FIG. 1 is a perspective view of a sheet from which the mat is formed;

Figure 1:
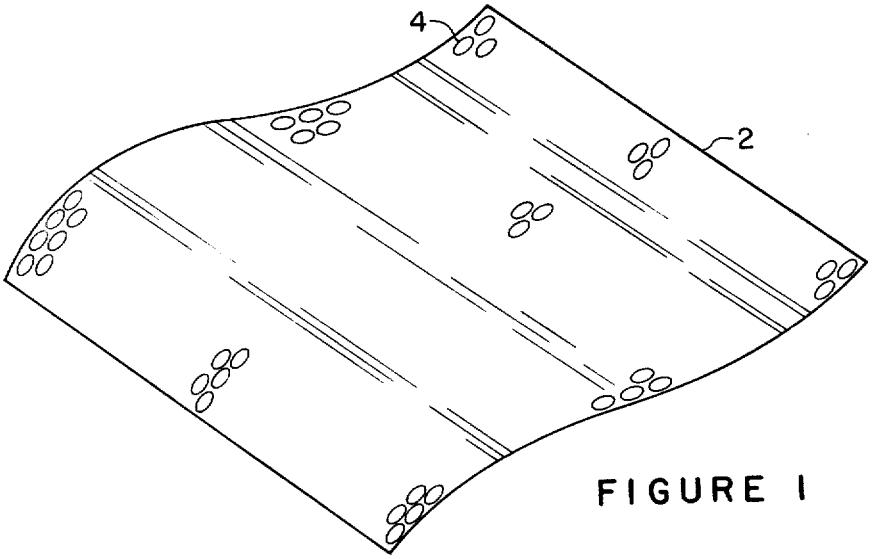

Referring more particularly to FIGS. 1 to 5 of the drawings reference numeral 2 indicates a thin steel sheet having closely spaced holes 4 therein. While only several holes 4 are shown in the drawings it will be understood that they are present over substantially all its surface. Since most of the steel has been removed this results in a very light weight sheet which may be easily bent and handled almost like cloth. A plurality of these sheets are used to make mat 6 of my invention. The sheets 2 are crumbled and intermeshed to form a honeycombed structure with random voids. The exact manner in which this is done has little importance, but they cannot be laid flat one on top of the other since this would give a solid and not a honeycombed or spongy structure.

Figure 2:
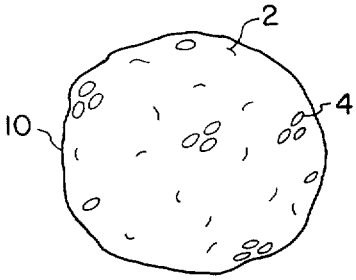
FIG. 2 is a view of a bundle formed from a number of sheets shown in FIG. 1.
Figure 3:
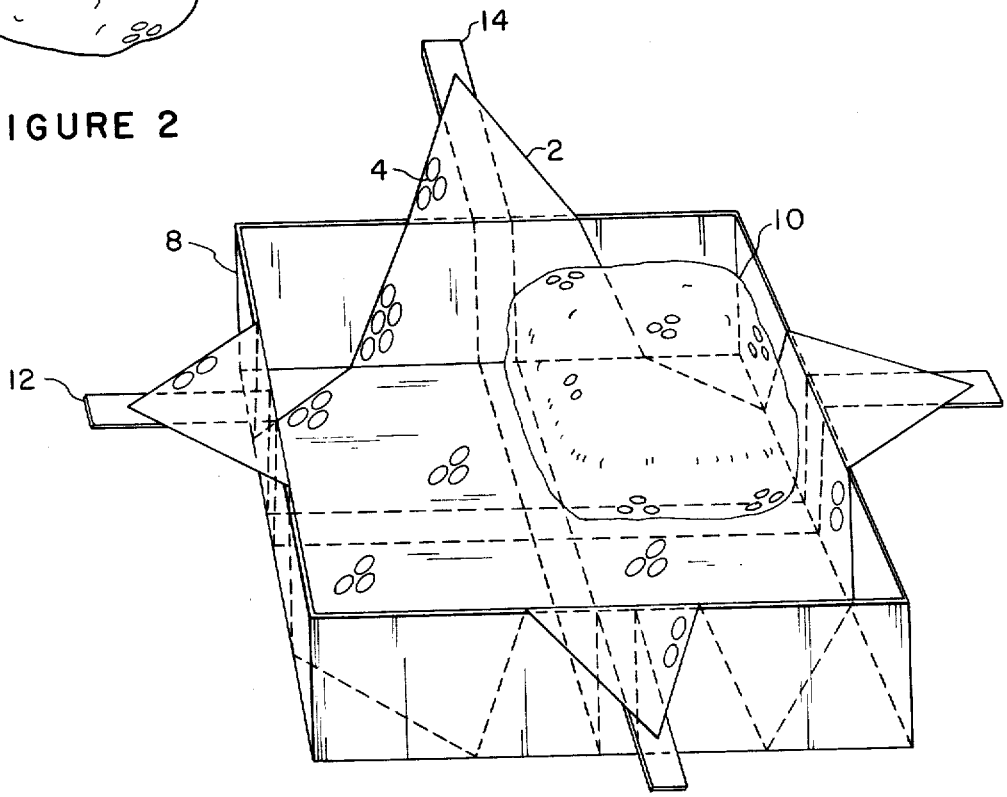
FIG. 3 is a perspective view of a step in the manufacture of a mat.
Figure 4:
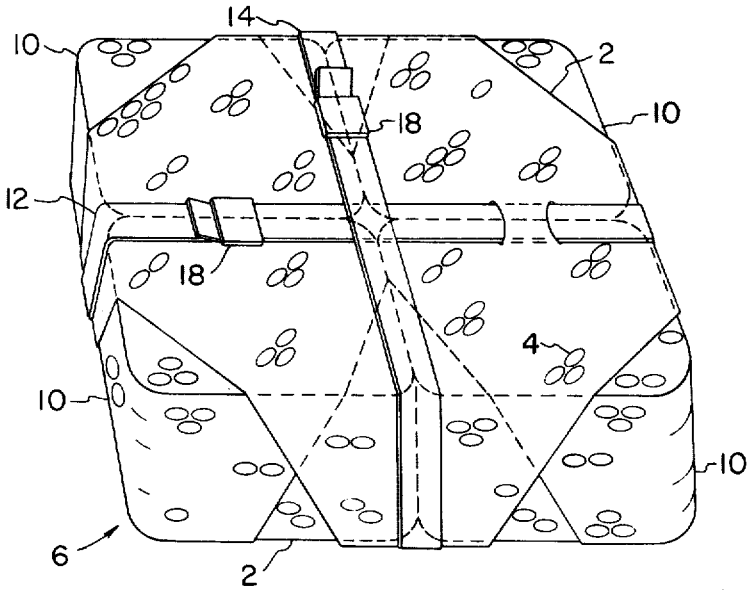
FIG. 4 is a perspective view of a completed mat.

One particular method of making a specific mat will be described. It will be understood that there are many sizes and shapes of ingot molds some of which have integral bottoms and others of which rest on stools. While my invention may be used with any type of mold it is particularly advantageous with those having stools, and the making of a mat for such use in a 71 cm. by 81 cm. mold for casting steel will be described. A box 8 of approximately that size and about 30 cm. deep is provided. Sheets 2 of 1010 tin free steel 91 cm.×91 cm.×0.066 cm. thick having closely spaced 3.5 cm. holes arranged in a staggered pattern are provided. One sheet is wrapped into a ball and second, third and fourth sheets are then wrapped successfully around the outside of the ball to form a bundle 10 as shown in FIG. 2. This operation is repeated to form additional bundles. Two bands 12 and 14 of similar steel are then placed symmetrically in crossed relationship on the bottom of box 8 with their ends extending up and above the sides of the box. A sheet 2 is then placed in box 8 on top of the bands with its corners approximately in the centers of the sides of the box and bent upwardly. Four bundles 10 are then placed on top of the sheet 2 in the box and a workman stamps the bundles 10 downwardly with a tool having a flat bottom so that the assembly of sheets in the box is approximately the same thickness throughout, but in a very porous or spongy condition. The material is then lifted from the box 8 by gripping the bands 12 and 14 and placed on the floor. The straps or bands 12 and 14 are passed through some of the holes in the bottom sheet and a flat sheet 2 is placed on top of the assembly. The ends of the top and bottom sheets are bent over the assembly and bands 12 and 14 are passed through holes in the top sheet. The ends of each of the bands 12 and 14 are then connected with clips 18 in the usual manner, thus completing the mat 6. This results in a mat approximately 12.7 cm. thick weighing approximately 6.35 kilograms. A solid piece of steel of this size would weigh approximately 570 kilograms. All parts of the pad are made of tin free steel which is compatible with the steel being poured.

Figure 5:
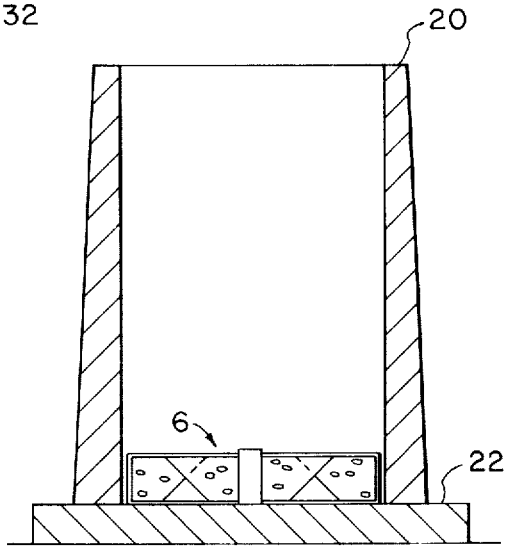
FIG. 5 is a view, partly in section, of a mat in a mold.

In use, the mat 6 held by the straps 12 and 14 is lowered into a mold 20 and rests on top of stool 22 as shown in FIG. 5. As molten steel is poured into the mold the mat absorbs the force of the molten stream and chills the steel so that it freezes sufficiently to seal the joint between the mold 20 and stool 22. The steel of the mat quickly melts and is absorbed into the ingot, thus losing its identity so that it need not be removed. Splashing of the mold wall is also greatly reduced.

It will be understood that the manner in which the sheets are crumbled may vary, but in all instances a honeycombed spongelike structure of considerable thickness will be formed having a plurality of discontinuous voids, none of which extend from the top sheet to the bottom sheet. The bands 12 and 14 are useful for handling purposes, but are not necessary to the operation of the mat.

Because of the great variety in mold height and cross section the size of the mats may vary to a large extent. However, to insure proper full proof operation it is preferred that the mat have a minimum thickness of approximately 5 cm. and that it cover all but 5 cm. around the periphery of the mold although it is only necessary that it cover the area impinged on by the falling molten metal. The upper limit of mat thickness is limited only to such extent that the amount of metal can be melted and absorbed into the ingot. The extent of the voids in the mat may vary greatly, but must not be less than 90% so that its total weight will not exceed 10% of solid metal of the same size. Preferably the weight should not exceed 1% of solid metal of the same size. In most cases the voids will exceed 90%, but sufficient metal will be present so that there will be no direct vertical path therethrough. All of these factors can be readily determined for particular conditions by means of a few trials which may be made while obtaining useable ingots.

Figure 6:
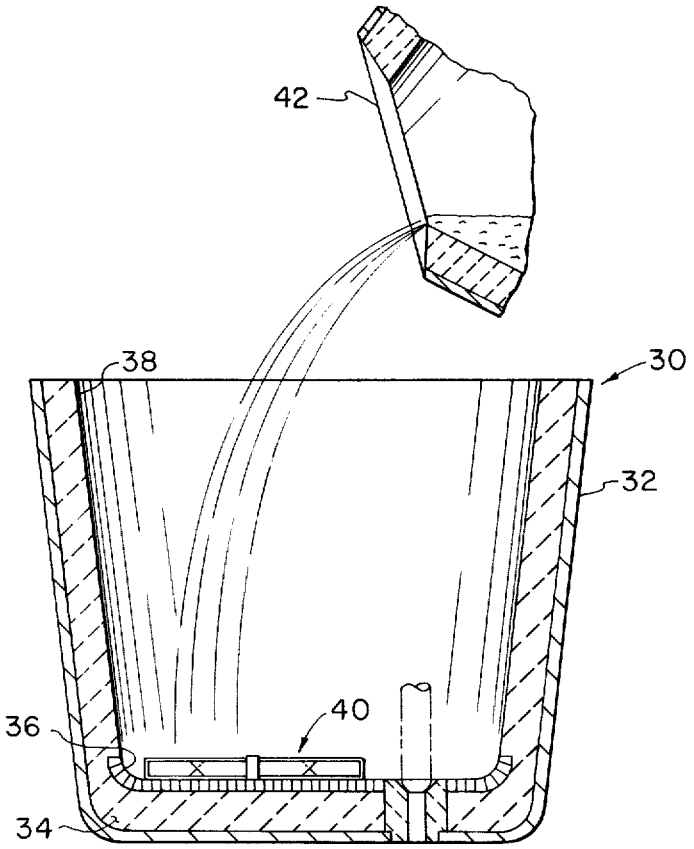
FIG. 6 is a sectional view of a ladle with a mat therein.

Referring now to FIG. 6, reference numeral 30 indicates a ladle for receiving molten steel. The ladle 30 includes a steel sheel 32 having its bottom lined with refractory bricks 34 with a refractory splash pad 36 on top thereof. The ladle 30 also has its sides lined with refractory 38. According to my invention, a mat 40 is placed on top of the splash pad 36. The mat 40 is constructed in the same manner as mat 6. However, the ladle is much larger than an ingot mold so that the mat must be much heavier than mat 6. For example, a ladle may have an inside diameter at its bottom of approximately 3.65 meters and a height of 4.57 meters. For such a ladle, it is preferred to use a mat approximately 90 cm. square and weighing approximately 18 kilograms.

In use, the mat 40 held by its straps is lowered into the ladle 30 and rests on top of the splash pad 36 generally centrally thereof. Molten steel is poured in a stream from an oxygen converter 42 onto the mat 40. The steel of the mat quickly melts and is absorbed into the molten metal, but not until the molten steel is sufficiently high to protect the splash pad 36 from the falling stream. Thus, the pad 36 will have a much greater life.

While it is only necessary that the mat be of sufficient size to receive the falling stream, this would require extreme accuracy in the pouring of the steel. For that reason it is preferred that the mat have a transverse shape similar to that of the stream with an area of at least three times that of the stream.

While several embodiments of my invention have been shown, modifications and adaptations may be made within the scope of the following claims.

I claim:

1. The method of pouring steel into a container having a bottom of substantial size and height which comprises:

providing a light weight tin free steel mat made from a plurality of thin crumbled sheets of tin free steel each having closely spaced holes therein throughout substantially all its surface and said sheets being arranged in a plurality of layers arranged to define a honeycombed spongelike structure of considerable thickness defining a plurality of discontinuous voids, and substantially flat individual thin sheets arranged on the top and bottom of said spongelike structure to form an assembly, said top and bottom sheets being made from a metal compatible with molten steel, none of said discontinuous voids extending from the top sheet to the bottom sheet, placing said mat on top of said bottom, and pouring molten steel in a stream of less cross-section than that of said mat on top of the mat with the honeycombed structure absorbing the force of the molten steel while it melts and is absorbed into the molten steel in the container.

2. The method of claim 1 in which the container is an open end ingot mold positioned on top of a stool forming its bottom, and said honeycombed structure chilling the steel so that it freezes sufficiently to seal the joint between the stool and mold while the steel in said mat is being melted and absorbed into the ingot.

3. The method of claim 2 in which said mat includes a first strap wrapped around the outside of said assembly, and a second strap wrapped around the outside of said assembly generally at right angles to the first strap, said straps being made of metal compatible with said molten steel, said mat being lowered into said mold by means of said straps.

4. The method of claim 1 in which the container is a ladle having a refractory bottom.

5. The method of claim 4 in which said mat includes a first strap wrapped around the outside of said assembly, and a second strap wrapped around the outside of said assembly generally at right angles to the first strap, said straps being made of metal compatible with said molten steel, said mat being lowered into the bottom of said ladle by means of said straps.

6. The method of claim 1 in which said mat includes a first strap wrapped around the outside of said assembly, and a second strap wrapped around the outside of said assembly generally at right angles to the first strap, said straps being made of metal compatible with said molten steel, said mat being lowered into the bottom of said container by means of said straps.

* * * * *